US005970957A

United States Patent [19]

Fried et al.

[11] Patent Number: 5,970,957

[45] Date of Patent: Oct. 26, 1999

[54] VAPOR RECOVERY SYSTEM

[75] Inventors: Marcus William Fried, Belleville; Peter Charles Moilanen, Dearborn Heights; William Jeffrey Clemens, Plymouth, all of Mich.

[73] Assignee: Ford Global Technologies, Inc., Dearborn, Mich.

[21] Appl. No.: 09/035,118

[22] Filed: Mar. 5, 1998

[51] Int. Cl.[6] ..... F02M 37/04

[52] U.S. Cl. ..... 123/516; 123/520; 123/533

[58] Field of Search ..... 123/516, 518, 123/519, 520, 531, 533

[56] References Cited

U.S. PATENT DOCUMENTS

| | | | |
|---|---|---|---|
| 4,070,828 | 1/1978 | Barres | 123/521 |
| 4,519,365 | 5/1985 | Sarich | 123/533 |
| 4,530,210 | 7/1985 | Yamazaki | 123/520 |
| 5,005,550 | 4/1991 | Bugin, Jr. et al. | 123/520 |
| 5,054,454 | 10/1991 | Hamburg | 123/520 |
| 5,245,974 | 9/1993 | Watson et al. | 123/518 |
| 5,275,145 | 1/1994 | Tuckey | 123/521 |
| 5,803,053 | 9/1998 | Pflieger et al. | 123/516 |

*Primary Examiner*—Thomas N. Moulis
*Attorney, Agent, or Firm*—Jerome R. Drouillard

[57] ABSTRACT

A fuel vapor recovery system for a direct injection internal combustion engine operating in both stratified and homogenous modes includes using fuel vapor with air assisted injectors. A compressor compresses a controlled mixture of fresh air and fuel vapor which is then delivered to the air supply of air assisted injectors, allowing fuel vapors to be purged from the vapor recovery system during all engine operating modes.

11 Claims, 1 Drawing Sheet

VAPOR RECOVERY SYSTEM

FIELD OF THE INVENTION

The present invention relates to fuel vapor recovery systems for internal combustion direct injection engines.

BACKGROUND OF THE INVENTION

Fuel vapor recovery systems are employed on motor vehicles to reduce atmospheric emissions of hydrocarbons by storing the hydrocarbons in a canister. The canister, which is coupled to the fuel tank, uses activated charcoal for absorbing the hydrocarbons. The canister is periodically purged by passing ambient air, which desorbs the hydrocarbons, through the charcoal. The resulting air and hydrocarbon mixture subsidizes the normal mixture of air, from the intake system, and fuel, from the fuel delivery system, inducted into the engine via the engine port. The canister is then able to again store hydrocarbons allowing the process to repeat.

To force ambient air through the canister, manifold vacuum is commonly used. However, manifold vacuum is a function of engine operating conditions. At certain conditions, the manifold vacuum may not be enough to force air through the canister. Also, the fuel vapor recovery process must be executed at regular intervals to assure that the canister does not become saturated. Thus, many vapor recovery systems utilize a pump, or compressor, in the system to allow purging of the canister at all operating conditions. Such a system is disclosed in U.S. Pat. No. 5,054,454.

The inventors herein have recognized numerous disadvantages with the above approaches. For example, when vapor recovery systems are utilized with direct injection engines, the requirement for purging at regular intervals is not fulfilled by simply using a pump, or compressor. In direct injection engines, the engine control system operates the engine in both a stratified mode and a homogeneous mode. In the stratified mode, a local cylinder volume containing an air and fuel mixture is surrounded by a cylinder volume of non-combustible mixture, such as pure air. In the homogenous mode, a mixture with relatively constant air/fuel properties is present throughout the cylinder volume. Conventional port injected purging systems can only form a homogeneous mixture because, when the engine inducts a mixture of air and fuel from the vapor recovery system, there is no way to form a stratified mixture. In other words, the stratified mixture depends on having an isolated region of a desired air/fuel ratio with the rest of the region filled with air. Thus, operation in a stratified mode, which is advantageous to fuel economy, is limited by the necessity to purge the canister, resulting in less than optimal fuel economy.

SUMMARY OF THE INVENTION

An object of the invention claimed herein is to provide a vapor recovery system to allow purging of stored hydrocarbons during operation of all engine modes, including the stratified mode of a direct injection spark ignition gasoline engine.

The above object is achieved, and problems of prior approaches overcome, by providing a fuel vapor recovery system for maintaining charge stratification of a direct injection internal combustion engine. The system comprises a plurality of air assisted injectors for injecting fuel and air into the engine. A compressor, for compressing a mixture of fuel vapor and air, is coupled to the air supply side of the air assisted injectors. A control valve controls a ratio of fuel vapor and air in the mixture in response to a desired vapor purge rate. A fuel vapor source supplies fuel vapor to the control valve.

In the present invention, the cylinder is filled with fresh air charge and the stratified zone is comprised of fuel from the fuel delivery system, the air and fuel mixture from the vapor recovery system, and the ambient air from the fresh air inlet.

An advantage of the above aspect of the invention is that the engine can operate with greater fuel economy.

Another advantage of the above aspect of the invention is that the engine can operate with reduced emissions.

Yet another advantage of the above aspect of the invention is that the vapor recovery system can operate with lower storage capacity, reducing vehicle weight and cost.

Other objects, features and advantages of the present invention will be readily appreciated by the reader of this specification.

BRIEF DESCRIPTION OF THE DRAWINGS

The invention will now be described, by way of example, with reference to the accompanying drawing, in which.

DESCRIPTION OF THE PREFERRED EMBODIMENTS

Figure 1:
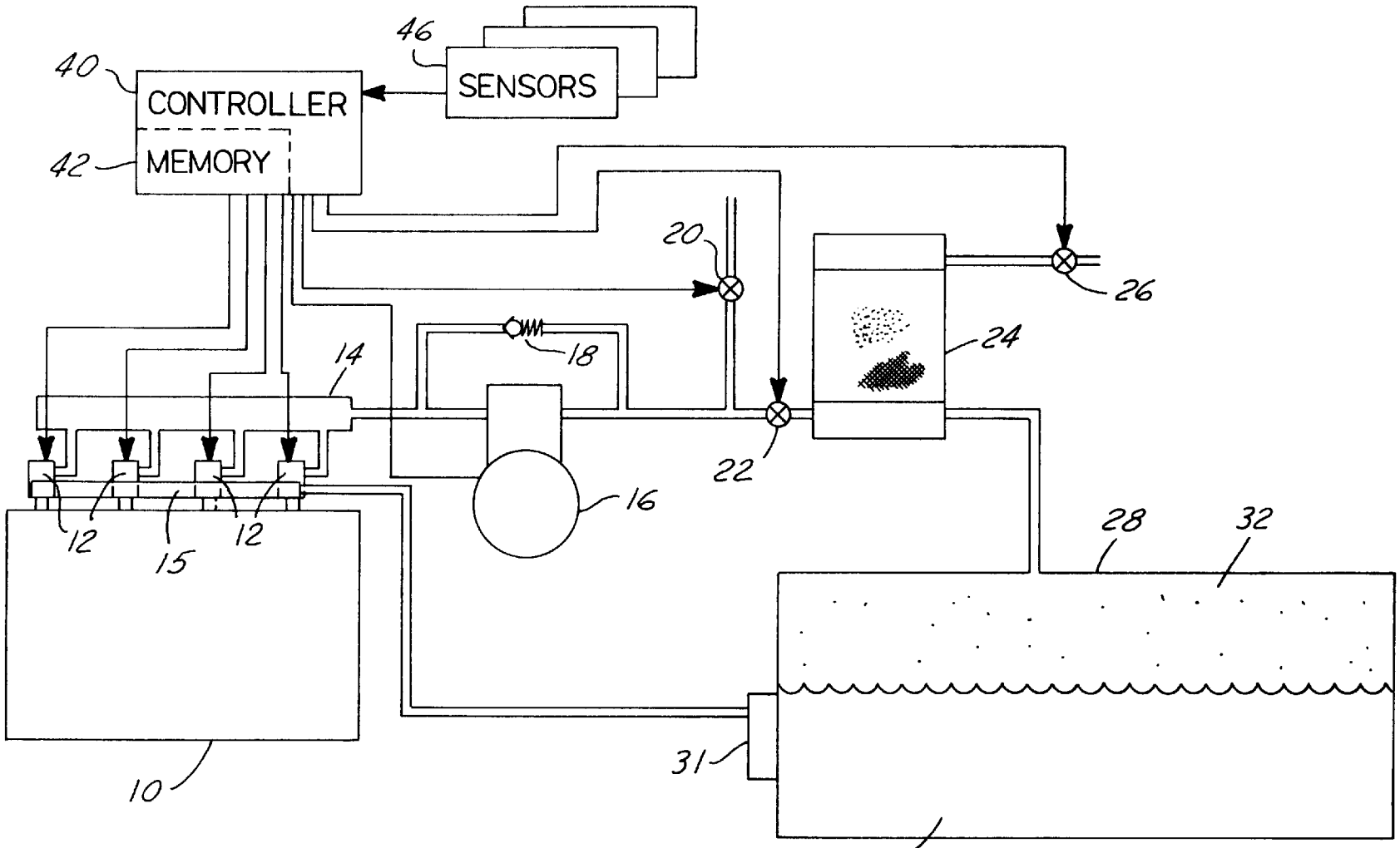
FIG. 1 is a block diagram of an engine incorporating a vapor recovery according to the present invention.

Multicylinder reciprocating internal combustion engine 10, shown in FIG. 1, comprises a plurality of electronically controlled air assisted fuel injectors 12. The air supply side of injectors 12 are in fluid communication with air rail 14 for creating a stratified charge mixture or a homogeneous charge mixture, as desired, in the engine cylinders (not shown). Air rail 14 is in fluid communication in a parallel relationship with the output of compressor 16 and the output of relief valve 18. Fuel rail 15, which is in fluid communication with the fuel supply side of injectors 12, is in fluid communication with fuel tank 28 to receive liquid fuel 30 via fuel delivery system 31 and associated supply lines. The inputs of compressor 16 and relief valve 18 are also in fluid communication with one another. Further, the output of ambient air control valve 20, which could be a simple on/off valve or a linear control type valve, and canister purge valve 22, which could also be a simple on/off valve or a linear control type valve, are in fluid communication with the inputs of compressor 16 and relief valve 18. The input of ambient air control valve 20 is in fluid communication with ambient air. The input of canister purge valve 22 is in fluid communication with canister 24. Canister 24 is in fluid communication with the ambient air through canister vent valve 26. Canister 24 is also in continuous fluid communication with fuel tank 28. Fuel tank 28 contains liquid fuel 30 and air and fuel vapor mixture 32. Fuel tank 28 also comprises a fill tube (not shown) for adding fuel. Alternatively, valve 22 may be in direct communication with tank 28, where no canister is used.

Continuing with FIG. 1, controller 40, having memory device 42, receives information from a plurality of sensors 46 regarding numerous engine operating parameters, such as engine speed, engine load, spark timing, intake manifold absolute pressure, and engine temperature and fuel system operating parameters, such as fuel tank temperature, fuel tank pressure, fuel delivery rate, compressor state, and fuel tank level and other parameters known to those skilled in the art. Controller 40 also controls air assisted fuel injectors 12, compressor 16, ambient air control valve 20, canister purge valve 22, canister vent valve 26, as well as many other actuators such as ignition coils, exhaust gas recirculation valves, and an electronic throttle.

Controller 40, which may comprise a conventional engine control microprocessor known to those skilled in the art, or a stand-alone processor, as desired, is charged with the task of operating engine 10 in both a stratified charge mode and a homogeneous charge mode. When no canister purging and either stratified or homogeneous operation is required, controller 40 operates canister vent valve 26 closed, canister purge valve 22 closed, and ambient air control valve 20 open. Compressor 16 compresses air passing through ambient air control valve 20 to a predetermined pressure regulated by relief valve 18. Compressed air from compressor 16 is delivered to air rail 14 for use by injectors 12 to enhance fuel properties, such as atomization, in the engine cylinders (not shown). At the same time, liquid fuel 30 from tank 28 is delivery to fuel rail 15 to be injected by injectors 12.

When purging of canister 24 is required, controller 40 adjusts canister vent valve 26, canister purge valve 22, and ambient air control valve 20 in response to a predetermined desired vapor purge rate. During purging operation, canister purge valve 22 is open, but canister vent valve 26 and air control valve 20 may be both open, both closed, or one open and one closed. For example, if the desired vapor purge rate is less than the vapor flow rate exiting canister purge valve 22, then ambient air control valve 20 is opened to dilute the vapor flow. More specifically, the vapor flow rate percent of total flow rate is controlled by adjusting the ratio of valve areas, which is defined as the flow area of air control valve 20 divided by the flow area of canister purge valve 22. Alternatively, if the valves are driven using pulse width modulation signals, the vapor flow rate percent is controlled by the ratio of the duty cycles of the pulse width modulated signals. Also, canister vent valve 26 can only be opened during purging and when the canister pressure is less than atmospheric pressure otherwise fuel vapor may escape into the atmosphere. Further, as would be obvious to one of ordinary skill in the art and suggested by this disclosure, air control valve 20 and purge valve 22 could be combined to form a single control valve.

Continuing with the description of purging operation, the mixture of vapor and ambient air is compressed by compressor 16 and delivered to air rail 14. Injectors 12 use the compressed mixture to enhance fuel properties, such as atomization, in the engine cylinders (not shown). Also, during operation of injectors 12, both fuel and the mixture of vapor and ambient air enter the engine cylinders (not shown).

Using a compressed mixture of vapor and air with injectors 12 allows the fuel vapors stored in canister 24 to be used in any mode of engine operation, thus eliminating the need to inject the fuel vapors in the engine port (not shown) so that the vapors mix with the fresh air charge inducted into engine 10 from the air intake system (not shown). Allowing the fresh air charge from the air intake system (not shown) to enter engine 10 uncontaminated maintains the ability to operate in either a stratified mode or a homogeneous mode, as desired. For example, conventional vapor recovery systems route fuel vapors stored in canister 24 to engine 10 by delivering the vapors to the intake manifold (not shown). There, the vapors are mixed with fresh air to form an air and fuel vapor mixture. This air and fuel vapor mixture is then inducted into the engine and injectors 12 inject additional fuel into the mixture. Thus, only a homogenous mixture can be created. However, by delivering the canister vapors to the injectors, only fresh air is inducted to fill the engine cylinders (not shown). Then, injectors 12 use the compressed fuel and air vapor to help atomize the injected liquid fuel, still creating a stratified charge despite the use of canister vapors.

While the best mode for carrying out the invention has been described in detail, those skilled in the art in which this invention relates will recognize various alternative designs and embodiments, including those mentioned above, in practicing the invention that has been defined by the following claims.

We claim:

1. A fuel vapor recovery system for maintaining charge stratification of a direct injection internal combustion engine comprising:

a plurality of air assisted injectors for injecting fuel and air into the engine;

a compressor, for compressing a mixture of fuel vapor and air, coupled to an air supply of each of the plurality of air assisted injectors;

a control valve for controlling a flow of fuel vapor and a flow of air in said mixture responsive to a desired vapor purge rate; and a fuel vapor source for supplying fuel vapor to said control valve.

2. The system recited in claim 1 wherein the fuel vapor source is comprised of a carbon canister coupled with a fuel tank.

3. The system recited in claim 1 wherein said compressor further comprises a relief valve for regulating an output pressure of said compressor.

4. The system recited in claim 1 wherein the fuel vapor source is comprised of a fuel tank.

5. A fuel vapor recovery control system for maintaining charge stratification of a direct injection internal combustion engine comprising:

a plurality of air assisted injectors for injecting fuel and air into the engine;

a compressor, for supplying a compressed mixture of fuel vapor and air, coupled to an air supply of each of the plurality of air assisted injectors;

a first control valve connected to the compressor for controlling a purge rate of fuel vapor;

a second control valve connected to the compressor for controlling a fresh air rate of fresh air;

a vapor source connected to the first control valve for supplying fuel vapor to said first control valve; and a controller for controlling a purge vapor flow rate by adjusting the first control valve and second control valve in response to a desired purge rate.

6. The system recited in claim 5 wherein said controller controls the vapor purge rate by changing a ratio of a first area of the first control valve and a second area of the second control valve.

7. The system recited in claim 5 further comprising a vent valve for allowing fresh air to enter said vapor source thereby allowing vapor to vent from said vapor source.

8. The system recited in claim 5 wherein the fuel vapor source is comprised of a carbon canister coupled with a fuel tank.

9. The system recited in claim 5 wherein the fuel vapor source is comprised of a fuel tank.

10. A fuel vapor recovery control method for maintaining charge stratification of a direct injection internal combustion engine comprising a plurality of air assisted injectors for injecting fuel and air into the engine, a compressor, for supplying a compressed mixture of fuel vapor and air, coupled to an air supply of each of the plurality of air assisted injectors, a first control valve connected to the compressor for allowing fuel vapor to enter the compressor, a second control valve connected to the compressor for allowing fresh air to enter the compressor, a vapor source connected to the first control valve for supplying fuel vapor to said first control valve, and a third control valve connected to the vapor source for allowing fresh air into the vapor source, the method comprising the steps of:

adjusting a vapor purge rate by changing a ratio of a first area of the first control valve and a second area of the second control valve in response to a desired purge rate; and changing a third area of the third control valve in response to the desired purge rate.

11. A fuel vapor recovery system for maintaining charge stratification of a direct injection internal combustion engine comprising:

a plurality of air assisted injectors for injecting fuel and air into the engine;

a compressor, for compressing a mixture of fuel vapor and air, coupled to an air supply of each of the plurality of air assisted injectors;

a pair of control valves for controlling a ratio of fuel vapor and air in said mixture responsive to a desired vapor purge rate; and a fuel vapor source for supplying fuel vapor to said control valve.

* * * * *